United States Patent [19]

Brown

[11] Patent Number: 4,996,802

[45] Date of Patent: Mar. 5, 1991

[54] SNAP FIT BUILDING STRUCTURE

[75] Inventor: Ronald L. Brown, Twyford, United Kingdom

[73] Assignee: Finch Conservatories Limited, Southampton, United Kingdom

[21] Appl. No.: 392,101

[22] Filed: Aug. 10, 1989

[30] Foreign Application Priority Data

Aug. 10, 1988 [GB] United Kingdom ..... 8819007

[51] Int. Cl.[5] ..... E04B 7/02

[52] U.S. Cl. ..... 52/90; 52/398; 52/461

[58] Field of Search ..... 52/398, 475, 730, 90, 52/92, 461, 397

[56] References Cited

U.S. PATENT DOCUMENTS

| | | | |
|---|---|---|---|
| 2,963,825 | 12/1960 | Douglas | 50/66 |
| 3,389,527 | 6/1968 | Collard | 52/461 X |
| 3,685,222 | 8/1972 | Curtess | 52/90 |
| 3,751,865 | 8/1973 | Brigham | 52/92 |
| 4,057,941 | 11/1977 | Schwartz | 52/90 X |
| 4,164,830 | 8/1979 | Bierlich | 52/398 |
| 4,308,858 | 1/1982 | Skiuman | 126/480 |
| 4,462,390 | 7/1984 | Holdridge et al. | 52/80 X |
| 4,671,027 | 6/1987 | Esposito | 52/105 X |
| 4,736,563 | 4/1988 | Bilhorn | 52/460 |

*Primary Examiner*—David A. Scherbel
*Assistant Examiner*—Creighton Smith
*Attorney, Agent, or Firm*—Cumpston & Shaw

[57] ABSTRACT

A conservatory is formed of extruded frame members which are interconnected with snap-fit connecting pieces. These may be location plates 43 or 43*a*, or frame dividers 33*a*–33*d*. The connecting pieces may also be glued in place, or held with screws. The conservatory can be assembled using unskilled labour and can be made to satisfy building regulations as to strength and stability. All the frame members are provided with spaced deformable flanges for locating the connecting pieces.

13 Claims, 5 Drawing Sheets

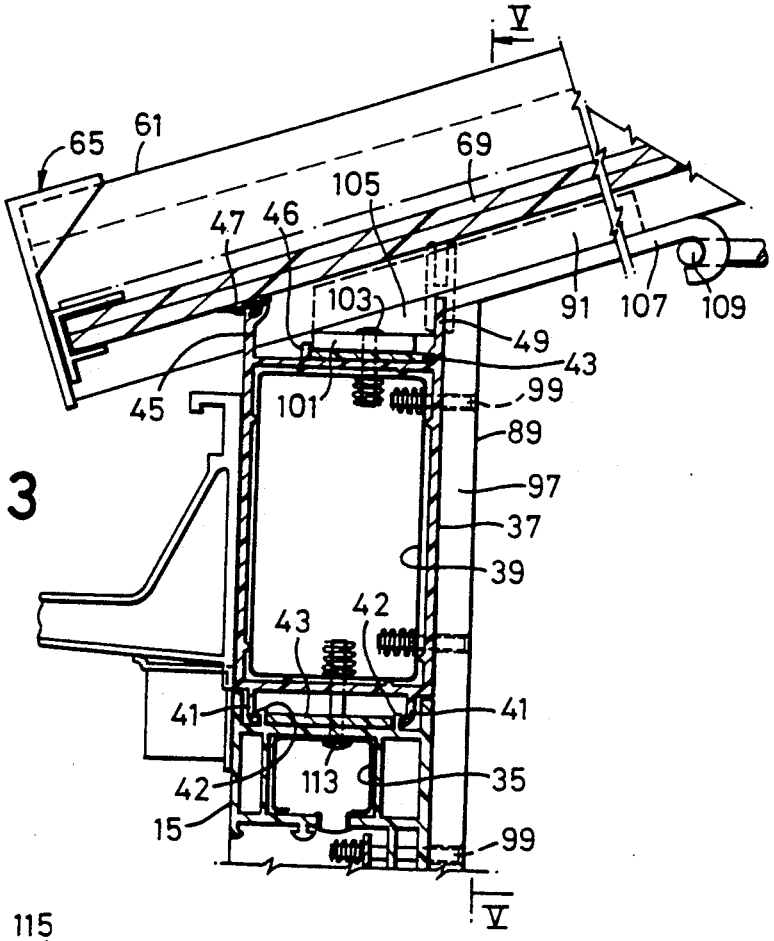
Fig. 3
Fig. 6
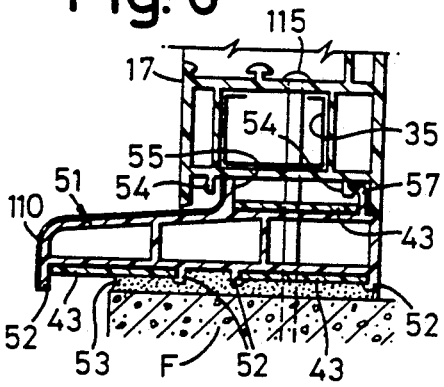
Fig. 4
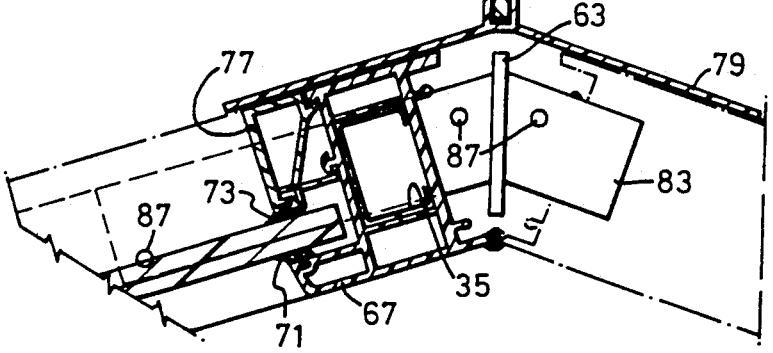

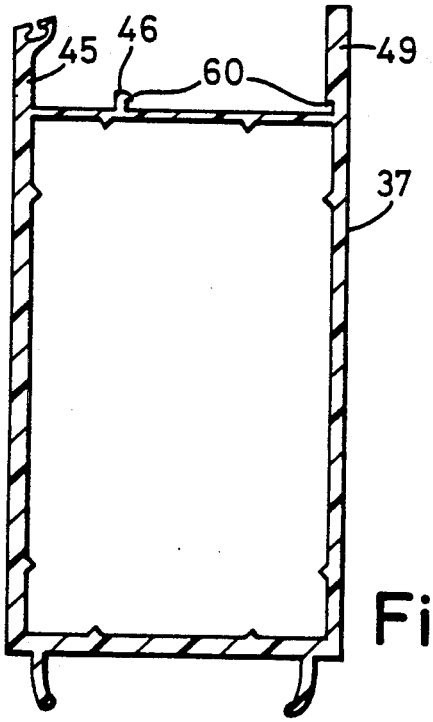
Fig. 10
Fig. 11
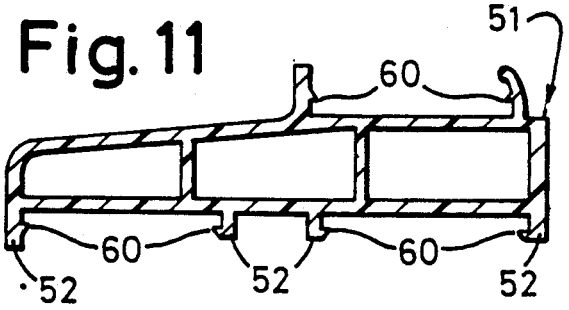
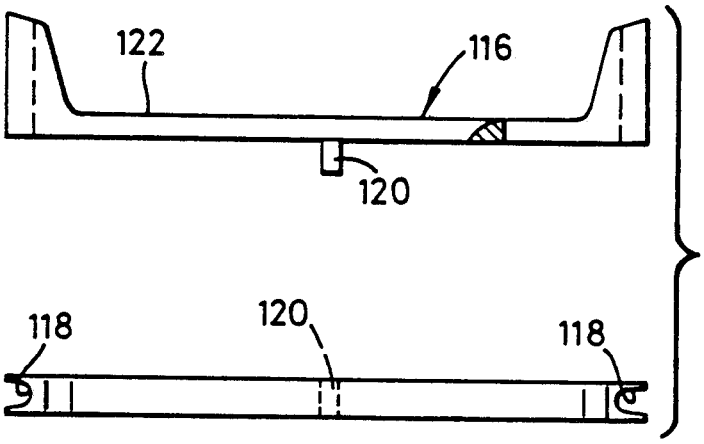
Fig. 12

SNAP FIT BUILDING STRUCTURE

This invention relates to a building structure such as a conservatory, greenhouse or bay window, in which the frame members are made up of extruded sections, e.g. uPVC sections, and more particularly to a conservatory, greenhouse or bay window or the like which can be assembled by the purchaser. In other words, a specialist contractor is not necessary, and the purchaser can 'self-assemble' the structure. Such a structure is hereinafter called 'a conservatory'.

Recently, more and more house owners have been installing conservatories, particularly "Victorian" designed (i.e. having angular ends), to provide an "outdoor" extension to their house but some prospective purchasers have not purchased because of the cost involved. Traditionally, conservatories have been built using wooden or metal frames but more recently there has been a tendency to use extruded uPVC frames and there is now a flourishing market for conservatories using either standard or special uPVC or other plastics frame sections. Although uPVC and other plastics frame sections are comparatively cheap to buy and fabricate into conservatory frames, the elements which add considerably to the cost and therefore restrict the market are:

(i) At the moment, the only method of forming uPVC sills and eaves beams for the angular ends to the Victorian designs is to cut, weld and polish the angular joints in the factory.

(ii) When manufactured, these two parts are large difficult shapes which create problems for storage and transportation. This in turn can result in damage which can be both expensive and inconvenient to rectify.

(iii) The present method of assembling the conservatory on site is complicated and requires skilled tradesmen to achieve a satisfactory finish. This adds approximately 50% to the materials, manufacturing and transport costs.

The present invention has been developed to overcome these problems and seeks to provide a conservatory construction which can be assembled and erected with comparatively unskilled labour and which can also satisfy Building Regulations as tó its structural strength and stability.

According to the present invention, we provide a conservatory having a frame formed from a plurality of extruded frame members and wherein selected ones of said frame members are connected to an adjacent frame member by a connecting piece which forms a snap fit with the two frame members it is connecting.

Preferably, the frame includes a plurality of upright glazed window frames of the same height, the upper ends of which are preferably united by eaves beams, and the lower ends of which are preferably united by sill plates.

Preferably, each upright window frame is comprised of two upright window frame members inter-connected by upper and lower horizontal window frame members and the upright frame member of one window frame is connected to the upright frame member of the adjacent window frame by a connecting piece in the form of an extruded uPVC clip-in vertical frame divider.

Preferably, each upright window frame member is of extruded hollow bar section with a galvanised metal reinforcement therein, and glazing means running along one face, and along its opposite face, front and rear flanges, between which are short L-shaped resiliently deformable flanges with which mating L-shaped deformable flanges on the frame divider connect.

Preferably, the upright window frame members are of the same cross-section as the upper, and lower horizontal window frame members, and the short L-shaped resiliently deformable flanges thereof form a snap-fit with mating deformable flanges on the underface of the eaves beams and an upper face of the sill plates, respectively.

Preferably, also, the spacing between said resiliently deformable flanges on the frame members, eaves beam and sill plates is the same, whereby adjacent, aligned frame members, or sill plates may be connected together by location plates which fit snugly between said flanges, and overlie the join between the aligned frame members or sill plates. Ribs or studs are provided on both faces of said flanges, enabling said location plates to form a snap-fit with the frame members or sill plates they are joining.

Preferably, upstanding flanges are provided on an upper face of the eaves beams at the same spacing as said other flanges, to enable aligned eaves beams to be joined with said location plates.

Preferably, the location plates are screwed or adhesively secured in position.

The principal use of the location plates is to form an angular shaped end wall for a "Victorian" design conservatory, e.g. of dexagonal or octagonal shape. To achieve this, the eaves beams and sill plates are cut to length and their ends are mitred at the desired angle, and a set of suitable shaped (angled) location plates is provided to connect said mitred and cut-to-length sill plates and eaves beams together. These shaped location plates can also be used to unite aligned upper and lower frame members of adjacent inclined window frames.

Such inclined window frames are however preferably also connected to their adjacent frames by suitably shaped and angled clip-in vertical frame dividers with rounded outer faces.

Preferably, each location plate has a central transverse upstand or plurality of spaced upstands (studs) to maintain a small space between the sill plates or eaves beams which they unite, and an extruded flexible uPVC cover strip having a space covering portion of rounded configuration on its exposed face and gripping portion which engages in said space is provided to form a seal between said spaced sill plates and eaves beams. Preferably, the cover strip is adhesively secured in position.

A self-assembly conservatory according to the present invention is now described by way or example with reference to the accompanying drawings, in which:

FIG. 3 is a transverse vertical section at the point B in FIG. 2, but to a larger scale, and showing how an eaves joint is formed;

FIG. 4 is a similar view to FIG. 3 but at the point A, showing how a ridge joint is formed;

FIG. 6 is ,a vertical transverse section at the point C in FIG. 2 showing how a wall of the conservatory is anchored at its lower end;

FIG. 10 is a section through an extruded uPVC eaves beam;

FIG. 11 is a section through an extruded uPVC sill plate, and

FIG. 12 shows various views of a roof bar saddle support for connecting roof bars to an eaves beam.

Figure 2:
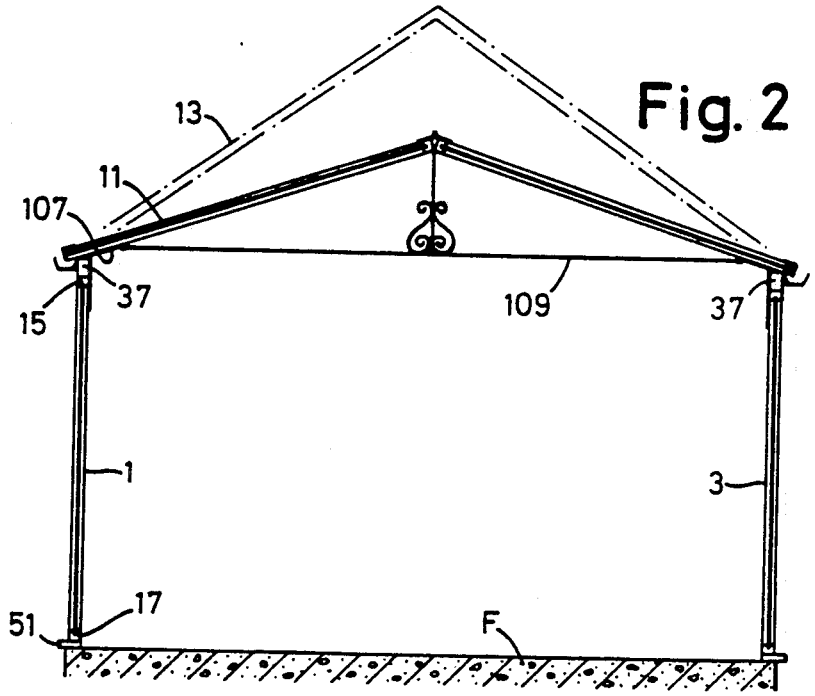
FIG. 2 is a transverse sectional view through the conservatory.
Figure 1:
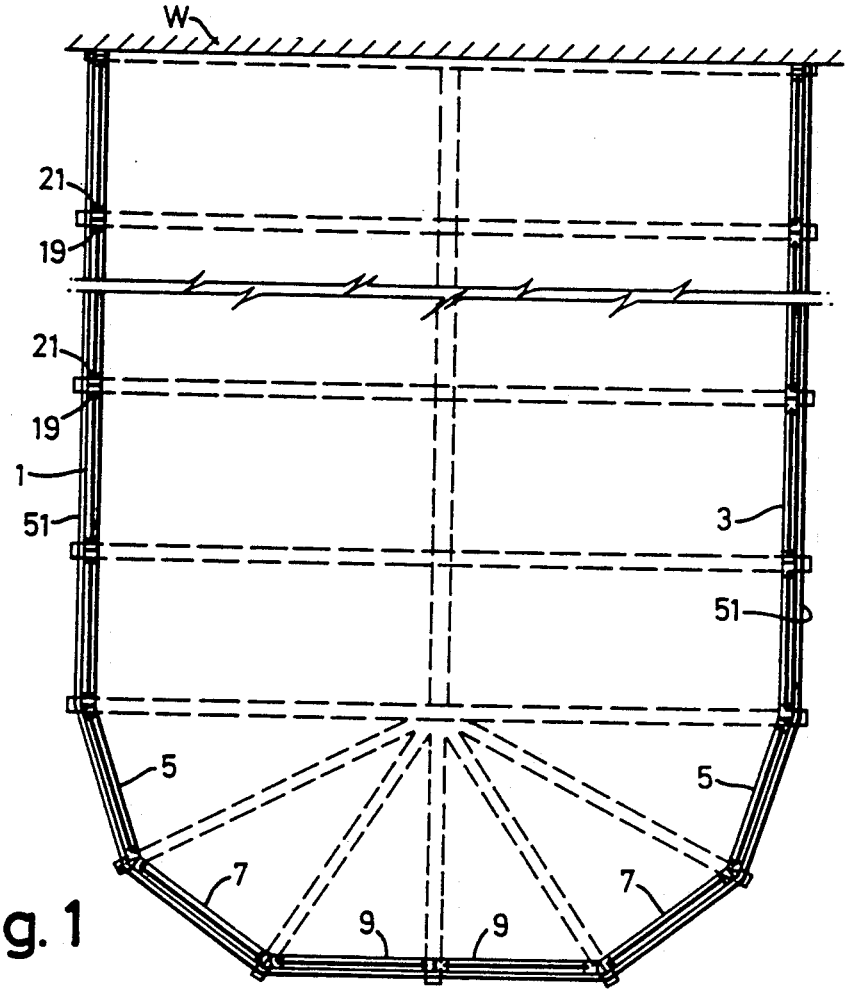
FIG. 1 is a partly schematic plan view of the conservatory.

Referring to FIGS. 1 and 2 of the drawings, the conservatory shown therein has opposed upright side walls 1 and 3, two end wall panels 5, two further end wall panels 7 and two yet further end wall panels 9 which together make up a dexagonal end, and a pitched roof which as a standard is either of 18° pitch as shown in full lines 11, or of 35° pitch as shown in broken lines 13. However, as a special, virtually any pitch can be constructed. As shown, the side walls 1 and 3 extend to ground level where they are fixed to a suitable foundation F, but they could equally easily be slightly shorter and be fixed to a dwarf wall. The conservatory can be of any chosen length and is shown abutting a wall W of a building. It can also be constructed as a free standing structure with dexagonal end in place of abutment to a wall.

The side walls 1 and 3 are made up of a plurality of rectangular glazed wall panels each comprised of an upper horizontal frame member 15 and a lower horizontal frame member 17 which are of identical cross-sectional construction and arranged as mirror images of each other as will hereinafter be described with reference to FIGS. 3 and 6, and a pair of horizontally spaced upright window frame members 19 and 21 which are of identical section to the members 15 and 17 (see FIG. 7). Where the respective frame members 15–21 abut at the corners of the frame, the members are mitred as shown at 23 in FIG. 5. (In the case of uPVC these joints are normally welded together but this is not essential). Suitable single, double or triple glazed panels 25 are located within the panel frames in known manner, one face of the panel 25 being sealed by a glazing gasket 27 and the other face by a gasket 29 located on the inner face of a clip-in glazing bead 31. As can be seen from FIG. 7, where the window frame member 19 of one glazed panel lies adjacent the window frame member 21 of the adjacent side wall panel, the two are clipped together in accordance with the invention using a purpose-made extruded snap-action vertical frame divider 33.

Figure 9:
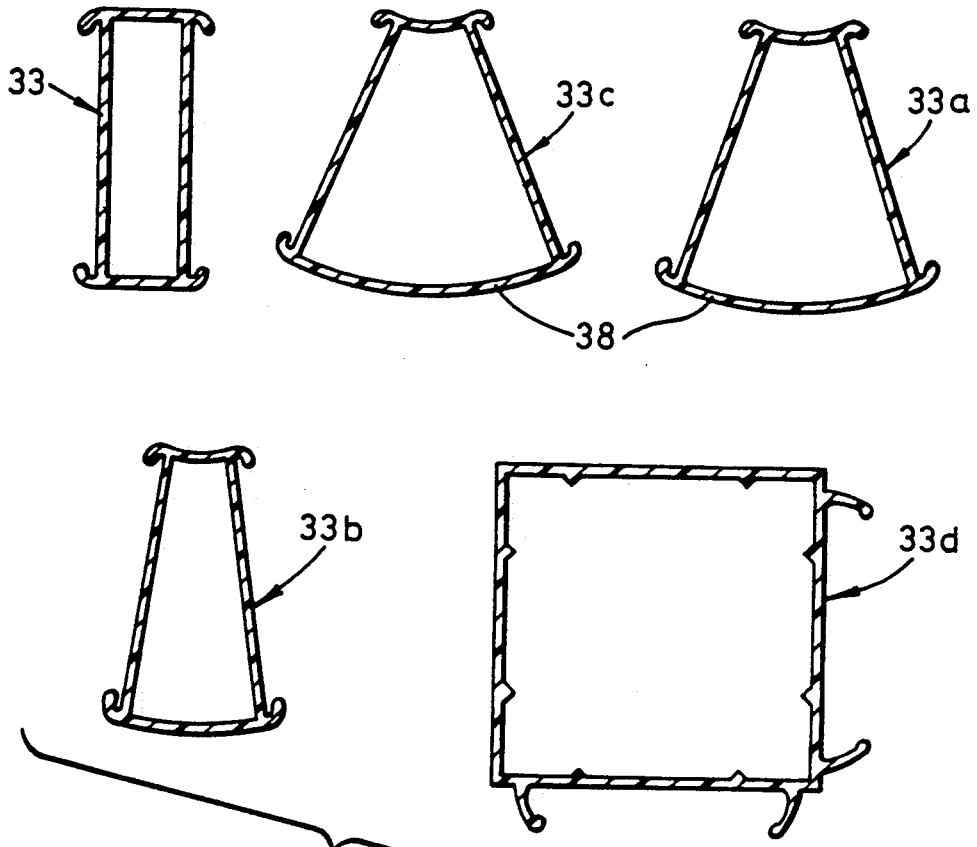
FIG. 9 shows cross-sectional views through five different vertical frame dividers.

Further frame dividers for joining adjacent window frame members at different angles, such as 144° at F and G in FIG. 1, or 162° as at H in FIG. 1, or at 135° for an octagonal end, are shown at 33*a*, 33*b*, 33*c* in FIG. 9. each of these has a rounded frame face 38. A corner post 33*d* is also illustrated for connecting adjacent upright frame members 19, 21 at a right angled corner.

Figure 7:
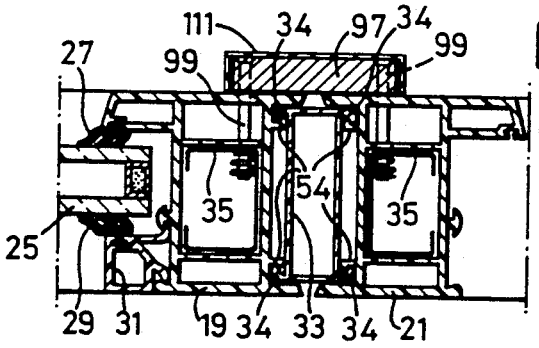
FIG. 7 is a horizontal section at the point D in FIG. 2.

Each of the frame dividers 33, 33*a*, 33*b*, 33*c*, 33*d* is used in the manner illustrated in FIG. 7 (which is illustrative of a straight joint) and on each side of the frame divider used for connecting adjacent upright frame members 19, 21, the divider, which is of extruded uPVC box section, is provided with a pair of inward facing generally L-shaped flanges 34 which form a snap-fit with mating, similarly shaped flanges or ribs 54 on the upright frame members 19, 21.

As can be seen from FIGS. 3, 6 and 7, all of the window frame members 15, 17, 19 and 21 are of generally box section and they are formed from extruded uPVC or some other suitable synthetic resinous material and they are strengthened internally by a rolled galvanised steel C-sectioned reinforcement beam 35.

The upper window frame members 15 are united along the whole length of the eave of each side wall by an extruded eaves beam 37 which itself is reinforced throughout its length by a rolled galvanised steel box-section beam 39 shown in detail in FIG. 10. While the frame members 15–21 are of standard section such as is made by Profilia S.p.A. of Italy, the eaves beam 37 is purpose-made and on its lower edge is provided with resiliently deformable ribs or flanges 41 which form a snap-fit with equivalent ribs or flanges 42 on the frame members 13. In accordance with the invention, the various side wall panels are maintained in their adjacent upright relationship prior to location of the beam 37 (in a modified arrangement this could even be omitted) thereon by short locating plates 43 which are located between the ribs or flanges 42 and bridge the joints between adjacent panels. These may be screwed or adhesively secured in place. Along its upper edge, the eaves beam 37 has an external flange 45 in the end face of which a gasket seal 47 is located for forming a seal with the underside of the roof and along its inner edge is a further upstanding flange 49.

The lower frame members 17 of each adjacent side wall panel are united along their bottom edges by an extruded hollow sill plate 51 shown in detail in FIG. 11. If it is necessary to make a join in the sill plate 51, further synthetic resinous location plates 43 are used which form a snap-fit between projecting ribs or flanges 52 on the lower side and ribs or flanges 55, 57 on the upper side of the plate, as shown in FIG. 6. These may also be screwed or adhesively secured in position. The sill plate is bedded in known manner on the foundation F or dwarf wall using mastic or cement mortar 53 and the flanges or ribs 55, 57 on the upper face of the sill plate are also used to locate and preferably form a snap-fit connection with mating ribs or flanges 54 on the underside of the frame member 17 as shown in FIG. 6.

The roof 11 (or 13) is formed from a plurality of extruded uPVC roof bars 61 (see FIG. 5) extending between a metal ridge bar 63 (see FIG. 4) and the respective eaves beams 37 but extending a little beyond the latter as shown at 65 in FIG. 3. The roof bars 61 are secured adjacent their lower ends to the eaves beams 37, and at their upper ends to the bar 63, as will hereinafter be described, and at their upper ends are interconnected by longitudinally extending extruded roof frame members 67 identical in cross-section with the frame members 15–21 and likewise, reinforced internally with reinforcement beams 35; the spacing of the roof bars 61 is arranged to coincide with that of the vertical window frame members defining each side wall panel or window frame. Suitable transparent polycarbonate or similar roofing sheets (or glass) 69 are supported by the roof bars 61 and frame members 67, there being suitable glazing gaskets 71 on the underside thereof supported respectively by flanges on the frame members 67 and roof bars 62 and further gaskets 73 on the upper side thereof supported by respective glazing beads 75 which form a snap-fit with the roof bars 61 and beads 77 which form a snap-fit with the frame members 67. It will of course be appreciated that the roof construction on the side of the ridge bar 63 remote from the frame member 67 shown in FIG. 4 is identical and will not therefore be described. A purpose-made extruded uPVC ridge capping strip 79 is located over the ridge bar 63 and frame members 67 as show in FIG. 4 and secured in place with double sided self-adhesive tape or adhesive.

So that the conservatory will satisfy Building Regulations and be able to withstand substantial wind pressure, maximum snow loading and unequal loadings, etc. without any fear of collapse, the frame is provided with rigid joints so that at least selected frames of the structure become portal frames.

Accordingly, the ridge bar 63 is provided throughout its length at spaced intervals with pairs of projecting metal legs 81, one leg of each pair extending from each side of the bar 63 (so that the legs of each pair are directly opposite each other), there being shorter pairs of directly opposed legs 83 located alternately with the longer legs 81. Each of the roof bars 61 incorporates a box section rolled galvanised steel reinforcement tube 85 therein and the dimensions of the legs 81 and 83 are such that they form a snug fit within the reinforcement tube 85. Each leg 82 and 83 is rigidly welded to the bar 63 and after the longer legs 81 have been inserted into the reinforcement tube 85, the roof bars 61 are rigidly bolted to the legs 83 through apertures 87 provided for the purpose in the legs 81, the bolts or screws thus forming a rigid joint. Further roof bars 61 are connected to the shorter legs 83 with only one bolt or screw.

At each eaves of the structure, each roof bar 61 which has been rigidly bolted to a longer leg 81 is rigidly secured to an upright frame member formed by the fixed-together window frame members 19 and 21 (see FIG. 7 and FIG. 1) and to the eaves beam 37. To achieve this rigid connection, an eaves bracket 89 described in detail with reference to FIGS. 3, 4 and 5. The bracket 89 has a first face plate 91 of generally inverted T-shaped construction which is bolted to the roof bar reinforcing 85 with bolts 93 passing through the stem of the T (which locates in a longitudinal recess 95 cut out of the underside of the bar 61), through the plastics material of the bar 61, at least two spaced bolts 93 being used. Integral with the face plate 91 is a second face plate 97 which is secured by eight spaced bolts 99 to the upright frame member defined by the two adjacent window frame members 19 and 21 and to the eaves beam 37, the upper four screws 99 passing through the beam 37 and into its box section reinforcement 39 and the four lower bolts 99 passing through the uPVC material of the frame members 19 and 21 so that two engage with the C-sectioned reinforcement of the member 19 and two engage with the equivalent reinforcement of the member 21.

If the conservatory is to have the standard roof pitch of 18° then the plate 91 will form an angle of 108° with the plate 97, but if the roof has a 35° pitch, then the angle will be 125°. Angles for other roof pitches would be on similar principle. Integral with the two plates 91 and 97 but extending in a plane at right angles thereto is a further plate 101 which is so orientated as to overlie the eaves beam 37, this plate 101 being secured to the eaves beam 37 by four bolts 103 which extend through the uPVC material of the beam 37 into the box section reinforcement 39. Joins formed in the eaves beam 37 are located immediately above one of the side wall frame members 19, 21 so that a rigid joint can be achieved with the aid of the bracket 89. However, as with the sill plate, a reasonably strong joint is achieved wherever it is formed by using a location plate 43 (see FIG. 3) which forms a snap-fit between a special upstanding flange 46 and the flange 49 on the rear of each adjacent beam, with the plate 43 bridging the join. The bracket 89 also includes a web portion 105 connecting a part of the plate 101 to the plate 91 for additional strength. A stirrup 107 extending up beneath the plate 91 and having a curved end portion secures the end of an eaves tie bar 109. A purpose-made uPVC extruded cover 111 overlies the plate 97 (this being an optional feature).

As can be seen from FIG. 3, the upper window frame members 15 are secured to the eaves beam 37 by bolts 113 which are accessible through a cappable access hole in the frame member 13 and pass through its reinforcement 35, the connector plate 43, the uPVC material of the beam 37 and into and through the reinforcement 39 of the eaves beam. Likewise, the lower window beam 17 is rigidly secured to the sill plate 51 and foundation F or dwarf wall on which the whole structure rests by anchor bolts 115 which pass through the reinforcement 35 of the member 17 and through numerous other layers of uPVC material and into the foundation F or dwarf wall.

In the preferred construction, each alternate frame has all its joints in the form of rigid joints such as have been described above, thus forming a portal frame, with adjacent frames incorporating joints of a less rigid nature. For example, whereas the upper ends of the roof bars are connected with single bolts to the shorter legs 83 on the ridge bar 63, the lower ends are connected to the ridge beam 37 with screws passing through the glazing flanges on the bar 61. Of course, each of the adjacent frames which is a portal frame is rigidly connected to its adjacent frame and to the next portal frame and/or the other frames and portal frames through the rigid ridge bar and eaves beams and through the sill plates 51 thus producing an absolutely rigid structure which will satisfy Building Regulations.

As can be seen from FIGS. 10 and 11, and to a lesser extent from FIGS. 3 and 6, each of the upstanding flanges 55, 57, 52, 46 and 49 is provided with a wedge-shaped projection 60 thereon, past which the location plate 43 must be forced, to provide the snap action connection of the plate to the respective eaves beam 37 or sill plate 51.

Where a sill plate 51 or eaves beam 37 is to be joined to another sill plate or eaves beam, it is important that a weatherseal is provided and that the joint looks attractive. This is achieved by using a flexible uPVC sealing strip 110 (see FIG. 6) which is designed sealingly to engage within a small gap of about 2 mm between the adjacent ends of two sill plates or eaves beams. The sealing strip 110 is mushroom-shaped in cross-section so as to have an arcuate upper face, the two extremities of which overlie end portions of the two members being joined, with the flat undersides thereof resting thereon and the stem of the mushroom shape, which may be provided in known manner with resiliently deformable sealing ribs or fins, being shaped and sized to form a push-fit in the gap between the two members being joined, the whole preferably being secured in place with adhesive. To ensure that this gap is of the right dimension, the location plate 43 for joining either the sill plates 51 or the eaves beams 37 in a straight line is provided at a central location with one or more upstands 112 of the required width, e.g. 2 mm, which locate(s) between the two end faces of the members being joined.

Figure 8:
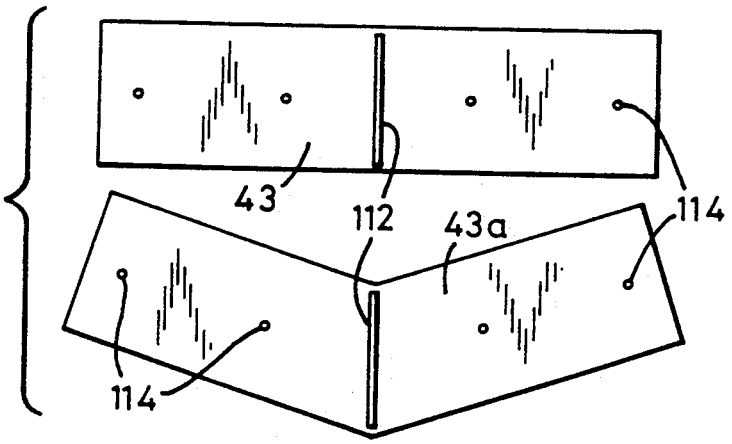
FIG. 8 is a plan view of two location plates.

Of course, where the end wall panels 5, 7 and 9 are to be joined to their adjacent panels with the aid of the frame dividers shown in FIG. 9, it will be necessary to provide short lengths of sill plate and eaves beam cut to the required lengths with their ends mitred at the correct angle. To connect these short lengths of eaves beam and sill plate together, special shaped location plates 43*a* (see FIG. 8) are required. As shown in FIG. 8, a plate having an included angle of 144° would of course be required for the 144° join at the points F and G in FIG. 1. These plates are used in the same manner as the straight plate 43 and are likewise provided with one or more upstands 112 correctly to space apart the sill plate portions and eaves beam portions being joined so that the correct width gap is left which is then sealed with a suitable length of uPVC sealing strip 110. All the various shaped location plates 43, 43*a* are provided with a plurality of apertures 114 therein to enable the plates to be screwed in position if required.

Figure 5:
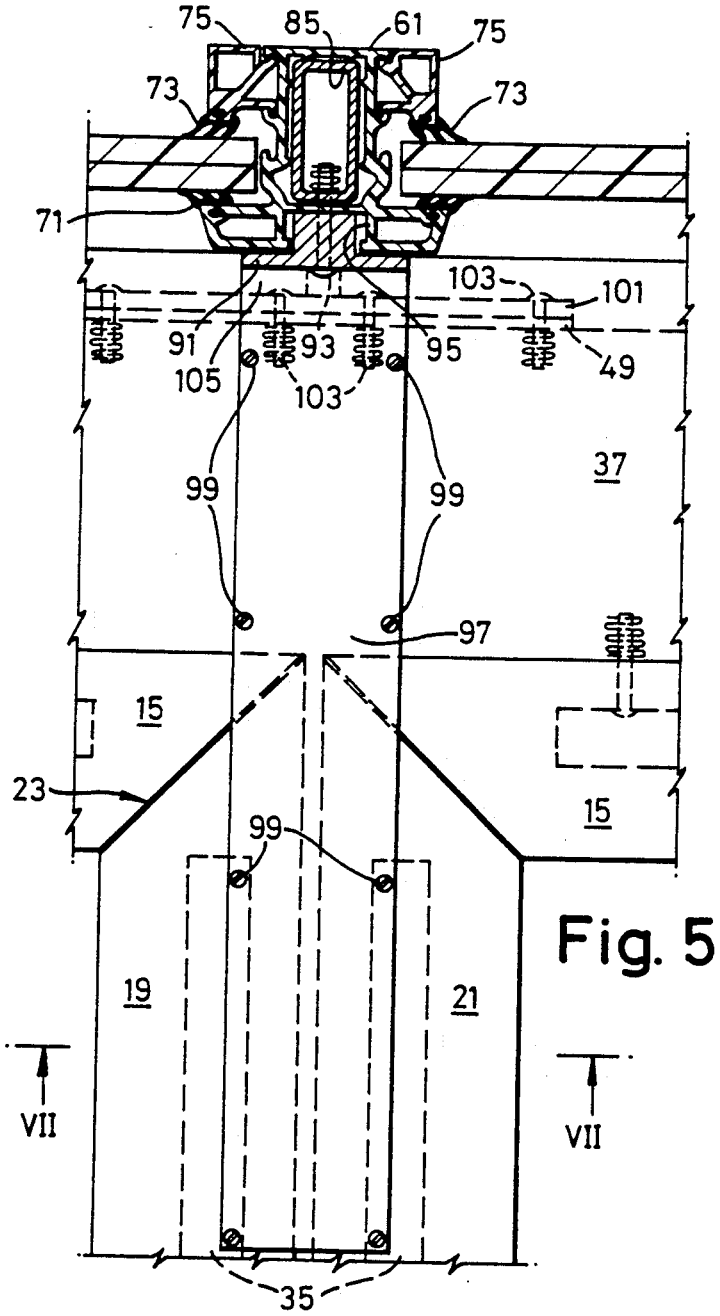
FIG. 5 is a longitudinal section, also at the point B in FIG. 2.

As already mentioned, a weatherseal between the side walls and roof of the conservatory is obtained by virtue of the gasket seal 47 carried by the flange 45 on the eaves beam engaging against the underside of the roofing sheets 69. However, where the roof bars 61 rest upon the eaves beams 37, it is necessary to cut away a sufficient length of the flange 45 to accommodate the lower portion of the roofing bar 61. In order positively to locate the roofing bar and so as to form a weathertight seal at this location, a roof bar saddle support 116 such as shown in FIG. 12 is used. Each roof bar saddle support is of shallow U-shaped construction with the inner wall thereof, defining the U-shape, being so shaped as snugly to receive the underside of the roof bar 61, the shape of which is illustrated in FIG. 5. Each end of the saddle support 16 is bifurcated as shown at 118 so that the saddle support can be positively located on the top front edge of the eaves beam (see FIG. 3) where a portion of the flange 45 has been removed so that the facing end portions of the flange 45 which still remain locate respectively in the two bifurcated portions 118 of the saddle support. Further to assist in the positive location of the saddle support, a depending location lug 120 is provided which, in the case of a straight length of eaves beam is located in a hole purposely drilled in the front edge of the top face of the eaves beam in the vicinity of the removed part of the flange 45. The roof bar saddle supports are preferably used to locate every roof bar on top of the eaves beam but are essential where the roof bars rest on the inclined joins between the side walls 1 and 3 and end wall panels 5 of the conservatory and at the joins between the respective panels 5, 7 and 9 because of course the eaves beam is not straight at these locations. As with a straight eaves beam, portions of the upstanding flange 45 are removed and in this case a saddle support 116 is located in position as with a straight eaves beam, but in this case the saddle support will bridge across the corner so that its central portion is spaced inwardly slightly from the apex of the corner.

Hence, because of the depth of the base 122 of the saddle support 116, the underface of the appropriate roof bar 61 will not just be supported on the apex of the corner but principally on the base of the U of the saddle support. This arrangement ensures a weathertight seal at every location where a roof bar 61 rests upon the eaves beam 37. Of course, at the angle joins in the eaves beam, cut-to-length mitred ends of the eaves beam portions will be spaced apart at the correct distance by the upstands 112 on the locator plates 43*a* and the locating lug 120 on the underside of the saddle support is so dimensioned as to form a close fit in the gap provided, thus making drilling unnecessary.

There are various other features of the conservatory which are new, such as purpose-made uPVC capping for the lower ends of the roof bars 61, purpose-made uPVC Dentil moulding, and curved bars for the upper portions of the side wall panels, and the caps for the sill plates, but all these and other component parts of the conservatory are illustrated in the accompanying drawings and need not be described in detail herein. Some of these features are however described in further detail in our co-pending patent application entitled "Building structure", being filed contemporaneously herewith, the contents of which are incorporated herein.

It will of course be understood that the present invention has been described above purely by way of example, and modifications of detail can be made within the scope of the invention.

I claim:

1. A conservatory having a frame formed from a plurality of extruded frame members and wherein selected ones of said frame members are connected to an adjacent frame member comprising:

a first pair of engagement means on each of two frame members to be connected;

a connecting piece; and second and third pairs of spaced apart engaqement means on said connecting piece for forming a respective dual snap fit with each of the first pairs of engagement means on the two frame members the connecting piece is connecting.

2. A conservatory according to claim 1 wherein the frame includes a plurality of upright glazed window frames of the same height, the upper ends of which are united by eaves beams, and the lower ends of which are united by sill plates.

3. A conservatory according to claim 2 wherein each upright window frame is comprised of two upright window frame members interconnected by upper and lower horizontal window frame members and the upright frame member of one window frame is connected to the upright frame member of the adjacent window frame by a connecting piece in the form of an extruded uPVC clip-in vertical frame provided.

4. A conservatory according to claim 2 wherein, in order to form an angular shaped end wall, the eaves beams and sill plates are cut to length and their ends are mitred at the desired angle, and a set of suitable shaped (angled) location plates is provided to connect said mitred and cut-to-length sill plates and eaves beams together.

5. A conservatory according to claim 4 wherein said inclined window frames are also connected to their adjacent frames by suitably shaped and angled clip-in vertical frame dividers with rounded outer faces.

6. A conservatory having a frame including a plurality of upright glazed window frames of the same height, the upper ends of which are united by eaves beams, and the lower ends of which are united by sill plates, wherein each upright window frames comprises two upright window frame members of extruded hollow bar section with a galvanized metal reinforcement therein, and glazing means running along one face, and along its opposite face, front and rear flanges, between which are short L-shaped resiliently deformable flanges; upper and lower horizontal window frame members; and an extruded uPVC clip-in vertical frame divider having mating L-shaped deformable flanges for connecting the upright frame member of one window frame to the upright frame member of the adjacent window frame.

7. A conservatory according to claim 6 wherein the upright window frame members are of the same cross-section as the upper and lower horizontal window frame members, and the short L-shaped resiliently deformable flanges thereof form a snap-fit with mating deformable flanges on the underface of the eaves beams and an upper face of the sill plates, respectively.

8. A conservatory according to claim 7 wherein the spacing between said resiliently deformable flanges on the frame members, eaves beam and sill plates is the same, whereby adjacent, aligned frame members, or sill plates may be connected together by location plates which fit snugly between said flanges, and overlie the join between the aligned frame members or sill plates.

9. A conservatory according to claim 8 wherein ribs or studs are provided on both faces of said flanges, enabling said location plates to form a snap-fit with the frame members or sill plates they are joining.

10. A conservatory according to claim 8 wherein upstanding flanges are provided on an upper face of the eaves beams at the same spacing as said other flanges, to enable aligned eaves beams to be joined with said location plates.

11. A conservatory according to claim 8, wherein the location plates are screwed or adhesively secured in position.

12. A conservatory according to claim 8, wherein each location plate has a central transverse upstand or plurality of spaced upstands (studs) to maintain a small space between the sill plates or eaves beams which they unite, and wherein an extruded flexible uPVC cover strip having a space covering portion of rounded configuration on its exposed face and a gripping portion which engages in said space is provided to form a seal between said spaced sill plates and eaves beams.

13. A conservatory according to claim 12 wherein the cover strip is adhesively secured in position.

* * * * *